US011231187B2

(12) United States Patent
Chu et al.

(10) Patent No.: US 11,231,187 B2
(45) Date of Patent: Jan. 25, 2022

(54) OUTDOOR UNIT FOR AIR CONDITIONER AND HOUSING THEREOF

(71) Applicants: GD MIDEA HEATING & VENTILATING EQUIPMENT CO., LTD., Foshan (CN); MIDEA GROUP CO., LTD., Foshan (CN)

(72) Inventors: Guangpei Chu, Foshan (CN); Junfei He, Foshan (CN); Shilin Qiu, Foshan (CN); Jian Liao, Foshan (CN); Yang Li, Foshan (CN); Lang Li, Foshan (CN)

(73) Assignees: GD MIDEA HEATING & VENTILATING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 80 days.

(21) Appl. No.: 16/627,487

(22) PCT Filed: Dec. 11, 2018

(86) PCT No.: PCT/CN2018/120314
§ 371 (c)(1),
(2) Date: Dec. 30, 2019

(87) PCT Pub. No.: WO2019/205654
PCT Pub. Date: Oct. 31, 2019

(65) Prior Publication Data

US 2020/0158355 A1 May 21, 2020

(30) Foreign Application Priority Data

Apr. 28, 2018 (CN) ..... 201810400832.0

(51) Int. Cl.
*F25B 39/02* (2006.01)
*F24F 1/56* (2011.01)
*F24F 1/16* (2011.01)

(52) U.S. Cl.
CPC . *F24F 1/56* (2013.01); *F24F 1/16* (2013.01)

(58) Field of Classification Search
CPC ..... F24F 1/56; F24F 1/06; F24F 1/16; F24F 1/50; E05B 65/00; E05B 65/02;
(Continued)

(56) References Cited

U.S. PATENT DOCUMENTS 6,599,183 B1 7/2003 Barber
2010/0139169 A1 6/2010 Patil
2017/0059189 A1* 3/2017 Lim ..... F24F 1/26

FOREIGN PATENT DOCUMENTS

CN 2133649 Y 5/1993
CN 2137281 Y 6/1993
(Continued)

OTHER PUBLICATIONS

The attached pdf file is the translation of CN101586838A (Year: 2009).*

(Continued)

*Primary Examiner* — Henry T Crenshaw
*Assistant Examiner* — Kamran Tavakoldavani
(74) *Attorney, Agent, or Firm* — Dilworth & Barrese, LLP.; Michael J. Musella, Esq.

(57) ABSTRACT

An outdoor unit for an air conditioner and a housing of the outdoor unit are disclosed. The housing includes a cabinet body, a side-by-side door and a door-latching assembly. The side-by-side door is used to open and close the cabinet body, and includes a first door body and a second door body which are opened side by side. The door-latching assembly includes a cabinet-locking member provided on the cabinet
(Continued)

body, a door-locking member provided on the first door body and a latch member provided on the second door body. The latch member is movable with respect to the second door body between a locked position where the latch member cooperates with both the cabinet-locking member and the door-locking member in a locked manner and an unlocked position wherein the latch member is separated from both the cabinet-locking member and the door-locking member.

16 Claims, 7 Drawing Sheets

(58) Field of Classification Search
CPC . E05B 1/0046; E05C 1/02; E05C 7/04; E05C 1/00; E05C 1/004
See application file for complete search history.

(56) References Cited

FOREIGN PATENT DOCUMENTS

| | | | | |
|---|---|---|---|---|
| CN | 2209201 | Y | | 10/1995 |
| CN | 2536744 | Y | | 2/2003 |
| CN | 1407204 | A | | 4/2003 |
| CN | 101586838 | A | | 11/2009 |
| CN | 101586838 | A | * | 11/2009 |
| CN | 201377234 | Y | | 1/2010 |
| CN | 201661146 | U | | 12/2010 |
| CN | 202493112 | A | | 10/2012 |
| CN | 202493112 | U | | 10/2012 |
| CN | 202530901 | A | | 11/2012 |
| CN | 202530901 | U | | 11/2012 |
| CN | 202745550 | U | | 2/2013 |
| CN | 103291152 | A | | 9/2013 |
| CN | 203962532 | U | | 11/2014 |
| CN | 204002164 | U | | 12/2014 |
| CN | 204112945 | U | | 1/2015 |
| CN | 204574301 | U | | 8/2015 |
| CN | 204574301 | U | * | 8/2015 |
| CN | 205283965 | U | | 6/2016 |
| CN | 205618052 | U | | 10/2016 |
| CN | 205743371 | U | | 11/2016 |
| CN | 205880695 | U | | 1/2017 |
| CN | 206256793 | U | | 6/2017 |
| CN | 206291364 | U | | 6/2017 |
| CN | 107421018 | A | | 12/2017 |
| CN | 107611795 | A | | 1/2018 |
| CN | 207230768 | U | | 4/2018 |
| CN | 207686473 | U | | 8/2018 |
| CN | 108758871 | A | | 11/2018 |
| EP | 1479860 | A1 | | 11/2004 |
| FR | 2523630 | A1 | | 9/1983 |
| GB | 1584924 | A | | 2/1981 |
| JP | H07166746 | A | | 6/1995 |
| JP | H1113375 | A | | 1/1999 |
| JP | 2006090052 | A | | 4/2006 |
| KR | 20170064689 | A | | 6/2017 |

OTHER PUBLICATIONS

The attached pdf file is the translation of CN204574301U (Year: 2015).*
Second OA for CN application 201810400832.0.
English translation of Second OA for CN application 201810400832.0.
International Search Report and Written Opinion dated Feb. 14, 2019 from State Intellectual Property Office of the P.R. China.
Second Chinese Office Action for corresponding Chinese Patent Application No. 201810400832.0 dated Jun. 15, 2020.
OA for CN application 201810400832.0 and English Translation dated Jan. 20, 2020.

* cited by examiner

OUTDOOR UNIT FOR AIR CONDITIONER AND HOUSING THEREOF

CROSS-REFERENCE TO RELATED APPLICATIONS

The present disclosure is a national stage filing of international application PCT/CN2018/120314, filed on Dec. 11, 2018, and claims priority to Chinese Patent Application No, 201810400832.0, filed on Apr. 28, 2018, the entire contents of each or which are incorporated herein by reference.

FIELD

The present disclosure relates to a field of air conditioner manufacturing technology, and more particularly to an outdoor unit for an air conditioner and a housing thereof.

BACKGROUND

In the related art, a panel of an outdoor unit for an air conditioner is fix to a cabinet body mainly by screwing. The fixing method is really inconvenient for maintenance, especially in the case of overhaul. If the maintenance is half done, but technicians need to get off work and the rest work needs to wait until the next day, the panel has to be mounted back to the cabinet body and then be dismounted on the next day, which is really troublesome. Moreover, stripped threads may occur and cause failure of screws and screw holes and become invalid due to frequent mounting and dismounting operations, such that the panel can no longer be mounted back into the cabinet body. In addition, once screws are lost, the panel cannot be mounted back into the cabinet, either.

SUMMARY

The present disclosure seeks to solve at least one of the technical problems existing in the related art. Hence, the present disclosure proposes a housing for an outdoor unit of an air conditioner, which can be opened or closed conveniently.

The present disclosure also proposes an outdoor unit for an air conditioner, having the above housing.

According to embodiments of a first aspect of the present disclosure, the housing includes: a cabinet body; a side-by-side door configured to open and close the cabinet body and including a first door body and a second door body that are opened side by side; and a door-latching assembly including a cabinet-locking member provided on the cabinet body, a door-locking member provided on the first door body and a latch member arranged on the second door body, the latch member being movable with respect to the second door body between a locked position where the latch member cooperates with both the cabinet-locking member and the door-locking member in a locked manner and an unlocked position where the latch member is separated from both the cabinet-locking member and the door-locking member.

For the housing according to embodiments of the present disclosure, by providing the side-by-side door and the door-latching assembly, it is convenient to open and close.

In some embodiments, the door-latching assembly is arranged inside the side-by-side door.

In some embodiments, the second door body has a manipulation hole configured to manipulate movement of the latch member between the locked position and the unlocked position.

In some embodiments, the latch member is provided with a handgrip portion, and during the movement of the latch member between the locked position and the unlocked position, the handgrip portion keeps corresponding to the manipulation hole.

In some embodiments, the door-latching assembly further includes a limiting member provided on the second door body, and the limiting member has two limiting portions. The handgrip portion is configured as a handgrip groove formed by a surface of the latch member recessed inwardly, and the handgrip groove moves between the two limiting portions, such that the locked position and the unlocked position can be reached respectively when two opposite side walls of the handgrip groove abut against the two limiting portions separately.

In some embodiments, a bottom wall of the handgrip groove has a locking hole, and the limiting member has at least one positioning hole. When the locking hole is opposite to the positioning hole, a threaded connector can pass through the manipulation hole and the locking hole to be locked with the positioning hole.

In some embodiments, two positioning holes are provided and arranged adjacent to the two limiting portions respectively, such that the locking hole is corresponding to the two positioning holes separately when the latch member moves to the locked position and the unlocked position.

In some embodiments, the latch member moves reciprocally and translationally between the locked position and the unlocked position. The latch member includes a first locking plate and a second locking plate spaced in a direction perpendicular to a moving direction of the latch member. When the latch member moves to the locked position, the first locking plate cooperates with the door-locking member in a locked manner, and the second locking plate cooperates with the cabinet-locking member in a locked manner.

In some embodiments, the cabinet body is open on a front side thereof, and includes a center beam vertically provided in the center of the front side. One of the first door body and the second door body is hinged to a left side edge of the cabinet body and is located between the left side edge and the center beam when closed, and the other one thereof is hinged to a right side edge of the cabinet body and is located between the right side edge and the center beam when closed. The cabinet-locking member is arranged on the center beam.

In some embodiments, the cabinet-locking member is arranged at a middle portion of the center beam; the door-locking member is arranged at a middle portion of a side of the first door body close to the center beam; and the latch member is arranged at a middle portion of a side of the second door body close to the center beam.

In some embodiments, at least one of the first door body and the second door body has a door handle portion.

An outdoor unit for an air conditioner according to embodiments of a second aspect of the present disclosure includes the housing according to embodiments of the first aspect of the present disclosure and a heat exchanger provided in the housing.

The outdoor unit according to embodiments of present disclosure has improved maintenance efficiency and cleaning efficiency, by providing the housing according to the above first aspect embodiments.

Additional aspects and advantages of embodiments of present disclosure will be given in part in the following descriptions, become apparent in part from the following descriptions, or be learned from the practice of the embodiments of the present disclosure.

DETAILED DESCRIPTION

Figure 1:
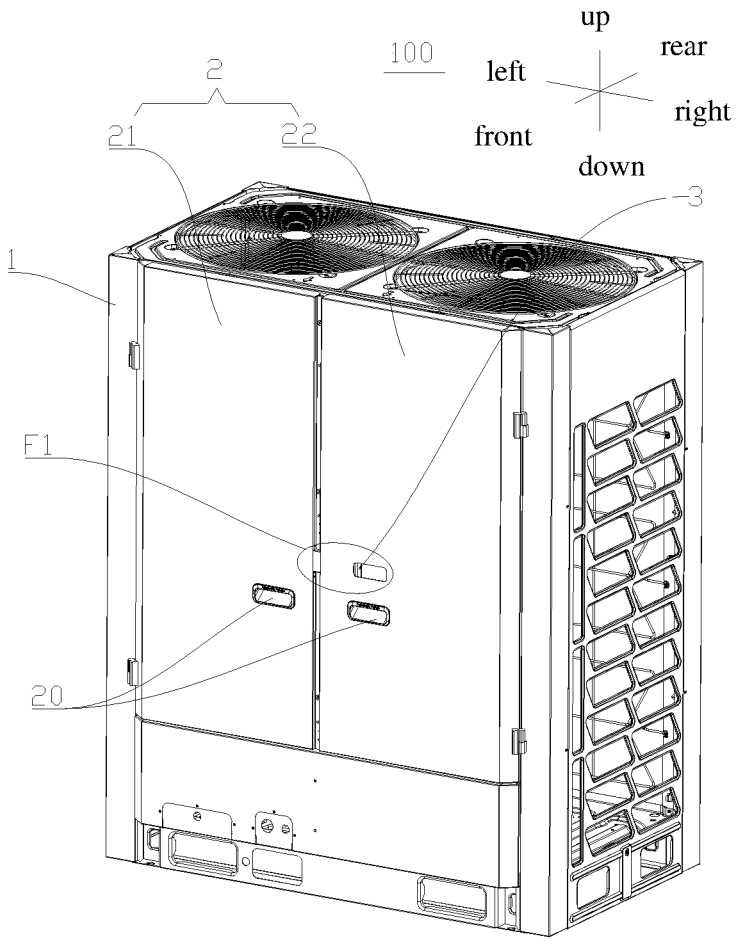
FIG. 1 is a view showing a side-by-side door of a housing in a closed state according to an embodiment of the present disclosure.

Embodiments of the present disclosure are further described. Examples of the embodiments are illustrated in the accompanying drawings. Same or similar reference signs represent the same or similar components or components that have the same or similar functions from beginning to end. The embodiments described below with reference to the accompanying drawings are exemplary, are merely used to explain the present disclosure, and cannot be construed as limitation to the present disclosure.

Various embodiments and examples are provided in the following description to implement different structures of the present disclosure. In order to simplify the present disclosure, certain elements and arrangements will be described. However, these elements and arrangements are only by way of example and are not intended to limit the present disclosure. In addition, reference numerals and/or letters may be repeated in different examples in the present disclosure. This repetition is for the purpose of simplification and clarity and does not refer to relations between different embodiments and/or arrangements. Furthermore, examples of different specific processes and materials are provided in the present disclosure. However, it would be appreciated by those skilled in the art that other processes and/or materials may be also applied.

A housing 100 for an outdoor unit for an air conditioner according to embodiments of a first aspect of the present disclosure will be described below with reference to FIGS. 1-14.

Figure 2:
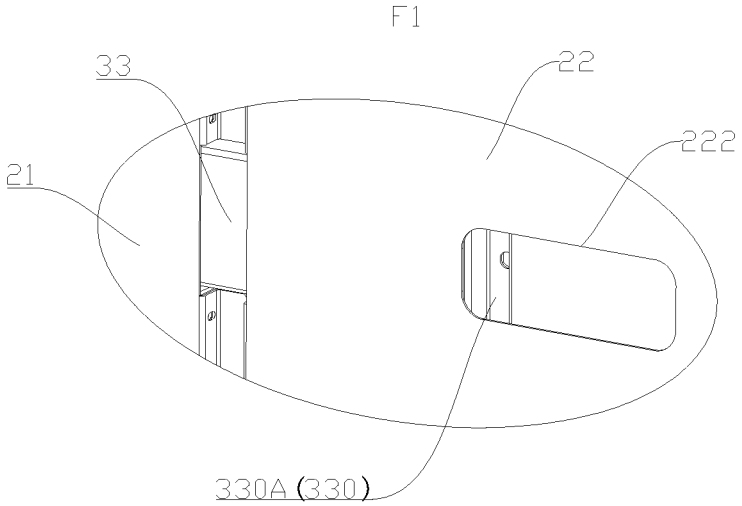
FIG. 2 is an enlarged view of part F1 circled in FIG. 1.

As illustrated in FIG. 1 and FIG. 2, the housing 100 according to the embodiments of the first aspect of the present disclosure includes: a cabinet body 1, a side-by-side door 2 and a door-latching assembly 3.

Figure 3:
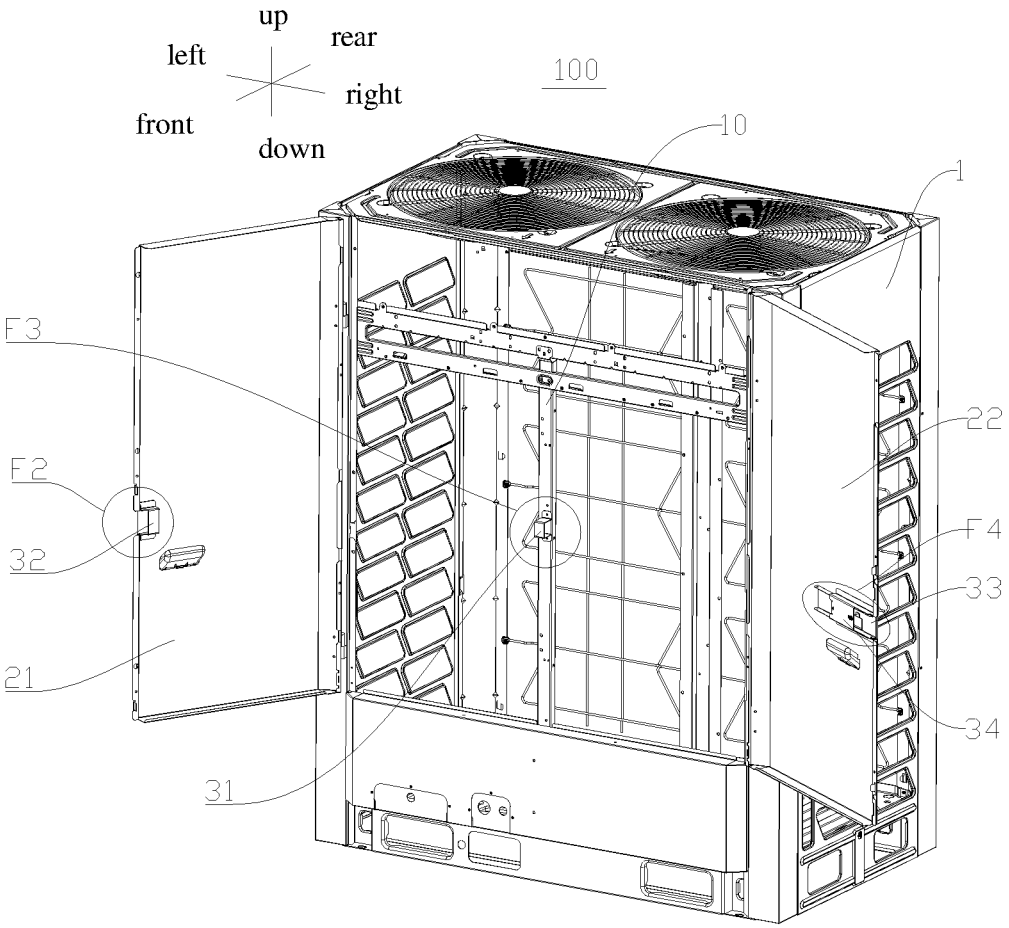
FIG. 3 is a view showing that the side-by-side door of the housing illustrated in FIG. 1 is in an open state.
Figure 4:
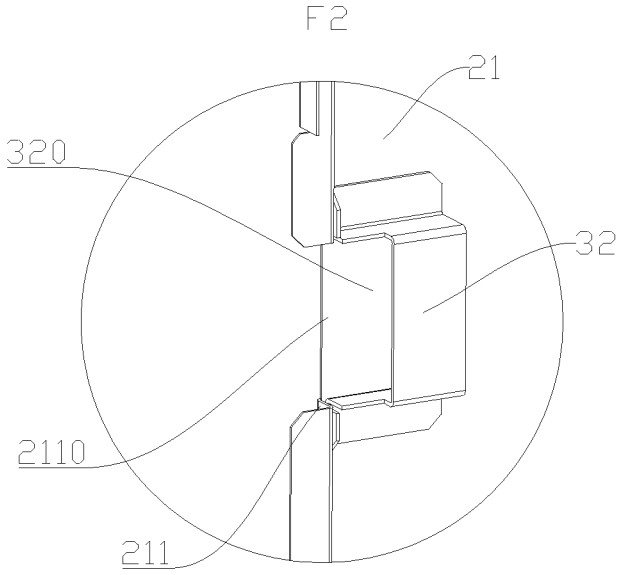
FIG. 4 is an enlarged view of part F2 circled in FIG. 3.
Figure 5:
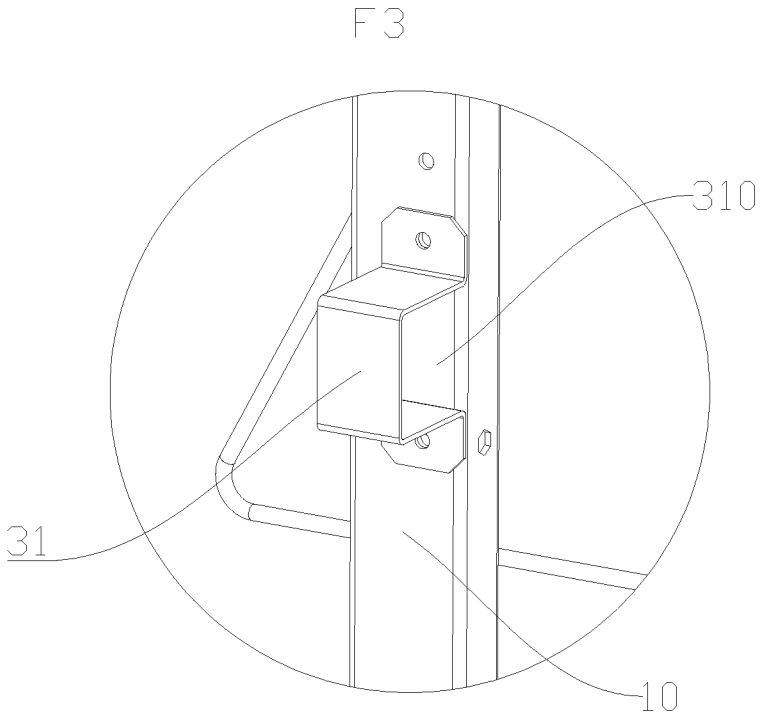
FIG. 5 is an enlarged view of part F3 circled in FIG. 3.

As illustrated in FIG. 3, the cabinet body 1 has a mounting space for accommodating working parts (such as heat exchanger, air blower, and so on) of the outdoor unit of the air conditioner, and the side-by-side door 2 is used to open and close the cabinet body 1 to open and close the mounting space. As illustrated in FIG. 1 and FIG. 3, the side-by-side door 2 includes a first door body 21 and a second door body 22 which are opened side by side. That is, the first door body 21 and the second door body 22 are both assembled and connected with the cabinet body 1 (such as hinged connection or sliding connection), and are opened or closed in opposite directions. For example, in a specific example illustrated in FIG. 3, the first door body 21 is pivotally connected with the cabinet body 1, and the first door body 21 pivots leftwards to be opened and pivots rightwards to be closed; the second door body 22 is pivotally connected with the cabinet body 1, and the second door body 22 pivots rightwards to be opened and pivots leftwards to be closed. For example, in another example of the present disclosure, the first door body 21 is slidably connected with the cabinet body 1, and translationally slides leftwards to be opened and slides rightwards to be closed; the second door body 22 is slidably connected with the cabinet body 1, and translationally slides rightwards to be opened and slides leftwards to be closed (this example being not illustrated in drawings).

Figure 7:
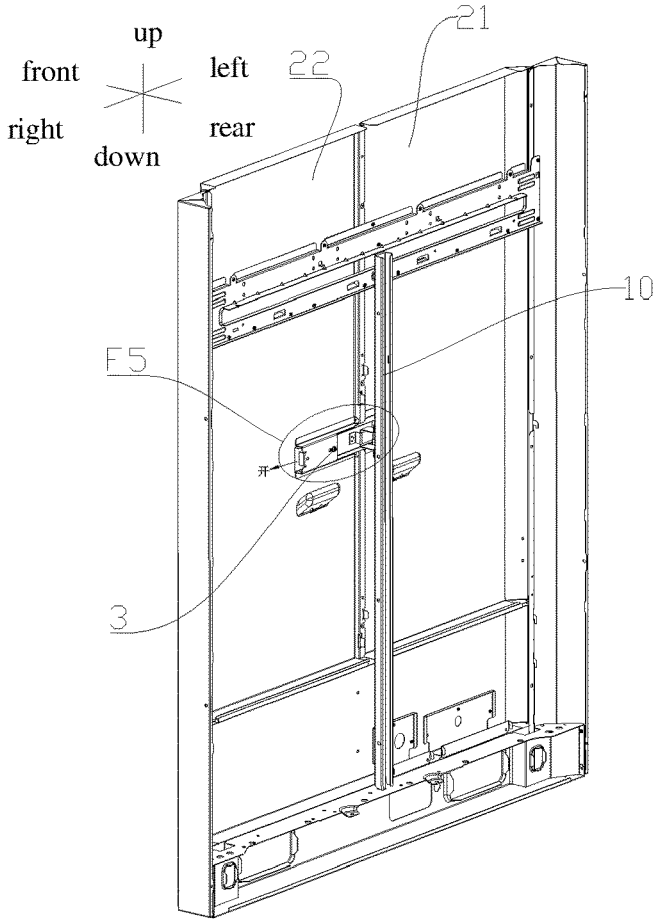
FIG. 7 is a view showing cooperation between the side-by-side door and a door-latching assembly illustrated in FIG. 1, wherein the latch member is in a locked position.

As illustrated in FIG. 1 and FIG. 7, the door-latching assembly 3 is used to lock the side-by-side door 2 when the side-by-side door 2 closes the cabinet body 1 so as to avoid the opening of the side-by-side door 2. That is, when the first door body 21 and the second door body 22 are both in closed positions, the first door body 21 and the second door body 22 are locked in the current positions so as to prevent either of the first door body 21 and the second door body 22 from moving towards an opening direction.

Figure 8:
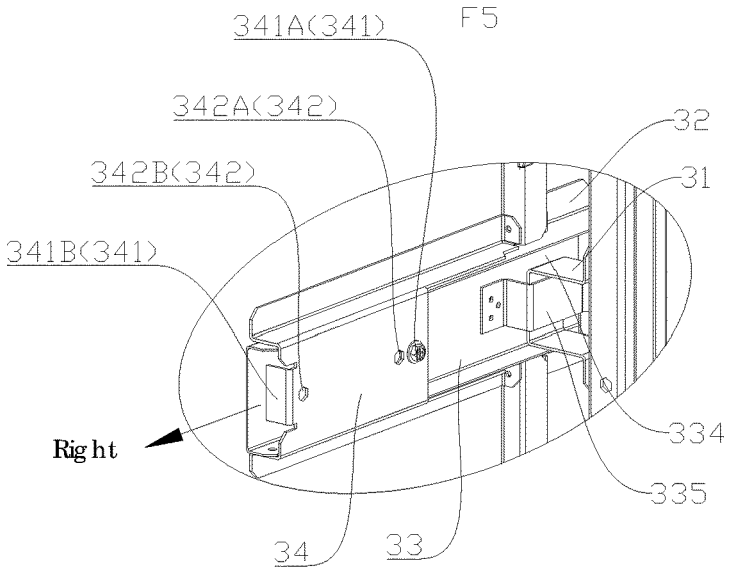
FIG. 8 is an enlarged view of part F5 circled in FIG. 7.
Figure 9:
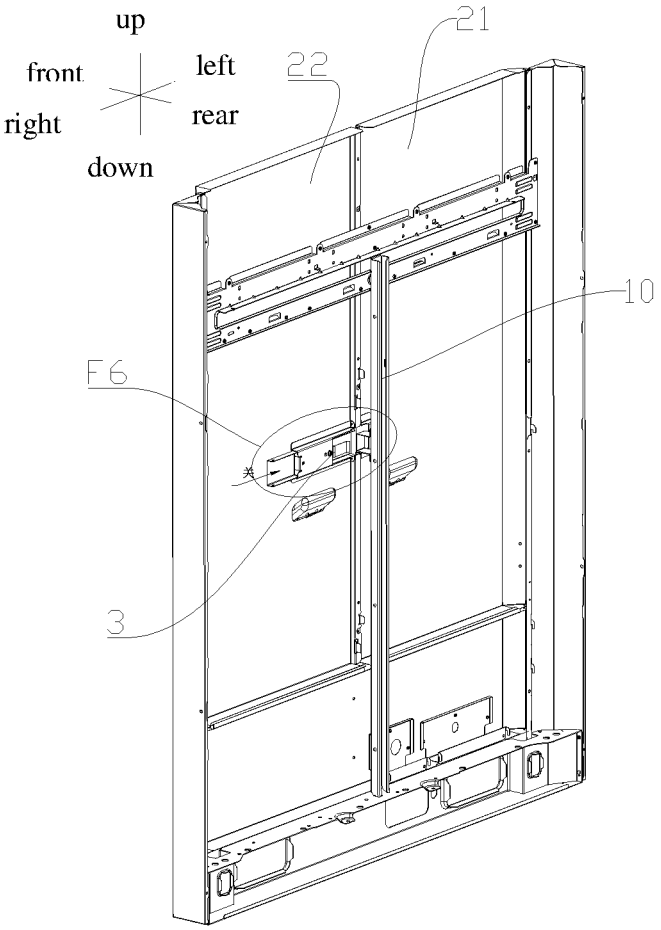
FIG. 9 is a view showing cooperation between the side-by-side door and a door-latching assembly illustrated in FIG. 1, wherein the latch member is in an unlocked position.
Figure 10:
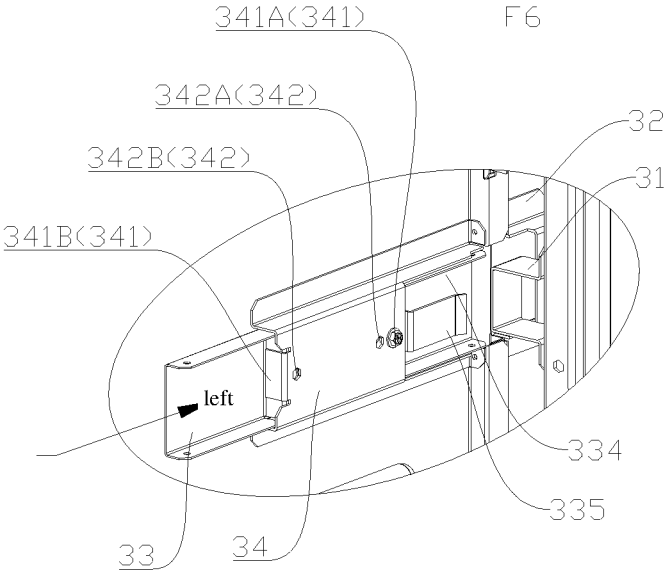
FIG. 10 is an enlarged view of part F6 circled in FIG. 9.
Figure 11:
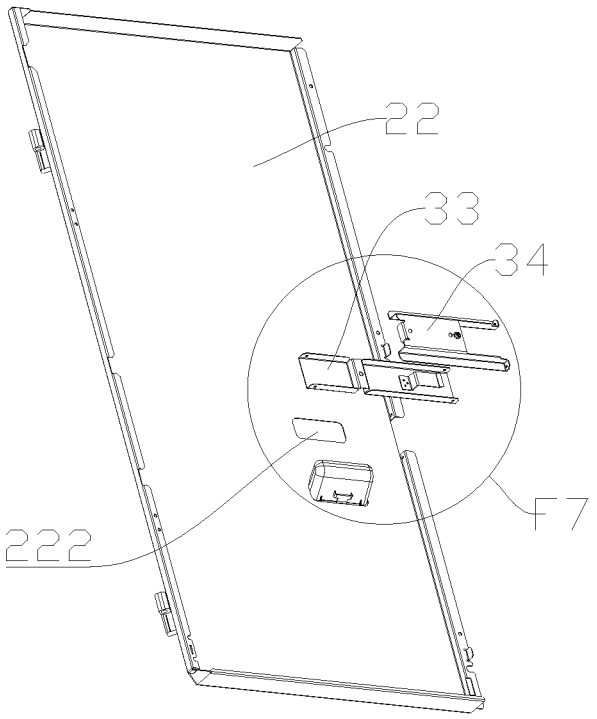
FIG. 11 is an exploded view of a second door body, a latch member and a limiting member illustrated in FIG. 9.

As illustrated in FIGS. 3-6, the door-latching assembly 3 includes a cabinet-locking member 31 provided on the cabinet body 1, a door-locking member 32 provided on the first door body 21, and a latch member 33 provided on the second door body 22. The latch member 33 is movable with respect to the second door body 22 between a locked position where the latch member 33 cooperates with both the cabinet-locking member 31 and the door-locking member 32 in a locked manner (as illustrated in FIG. 8) and an unlocked position where the latch member 33 is separated from both the cabinet-locking member 31 and the door-locking member 32 (as illustrated in FIG. 10). That is, the latch member 33 is movable between the locked position and the unlocked position. As illustrated in FIG. 7 and FIG. 8, when the latch member 33 moves to the locked position, the latch member 33 cooperates with the cabinet-locking member 31 and the door-locking member 32 in the locked manner respectively to realize the locking. The first door body 21 and the second door body 22 cooperate with the cabinet body 1 in a limited manner respectively, in which case the side-by-side door 2 is locked in a closed state, that is, the first door body 21 and the second door body 22 are both in the closed position and cannot be opened. As illustrated in FIG. 9 and FIG. 10. When the latch member 33 moves to the unlocked position, the latch member 33 is separated from the cabinet-locking member 31 and the door-locking member 32 respectively to realize the unlocking. The first door body 21 and the second door body 22 are separated from the cabinet body 1, in which case the side-by-side door 2 may be released to be opened, that is, the first door body 21 and the second door body 22 may both move toward open positions.

As for the housing 100 for the outdoor unit for the air conditioner according to embodiments of the present disclosure, the side-by-side door 2 can be closed and locked even without nailing screws 341A, by providing the side-by-side door 2 and the door-latching assembly 3, thus greatly improving the locking efficiency and unlocking efficiency of the side-by-side door 2, so as to greatly improve the opening and closing efficiency of the housing 100, which provides technicians with operational convenience and facilitates technicians to maintain and clean the outdoor unit, thus improving the maintenance efficiency and cleaning efficiency.

Compared with the related art, workload of disassembling the panel to open the housing 100 for maintenance of the outdoor unit is eliminated, so the maintenance efficiency is greatly improved. Moreover, the problem that the panel cannot be mounted back to the cabinet body 1 due to the stripped threads and failure of the screws 341A caused by nailing the screws 341A repeatedly to fix the panel, is avoided. Furthermore, the problem that the panel cannot be mounted back to the cabinet body 1 due to the loss of the screws after being disassembled is avoided. In addition, the service life of the housing 100 can be extended since there is no need to nail the screws 341A.

In some embodiments of the present disclosure, as illustrated in FIG. 1 and FIG. 3, the door-latching assembly 3 is arranged inside the side-by-side door 2 (that is, the cabinet-locking member 31 is arranged inside the first door body 21 and the second door body 22, the door-locking member 32 is arranged inside the first door body 21, and the latch member 33 is arranged inside the second door body 22). That is, the door-latching assembly 3 is arranged on a side of the side-by-side door 2 close to the cabinet body 1. For example, when the side-by-side door 2 is arranged on a front side of the cabinet body 1, the door-latching assembly 3 is arranged on a rear side of a front panel of the side-by-side door 2. For another example, when the side-by-side door 2 is arranged on a left side of the cabinet body 1, the door-latching assembly 3 is arranged on a right side of a left panel of the side-by-side door 2. Therefore, the door-latching assembly 3 cannot be observed from the outside of the housing 100, avoiding affecting the overall appearance of the housing 100, so as to ensure the aesthetic appearance of the housing 100. Moreover, the door-latching assembly 3 is not exposed to the outside, so it is not easily damaged by collision and is not easily wet and corroded by rain and snow.

Certainly, the present disclosure is not limited thereto. In other embodiments of the present disclosure, the door-latching assembly 3 may also be arranged outside the side-by-side door 2 (that is, the cabinet-locking member 31 is arranged outside the first door body 21 and the second door body 22, the door-locking member 32 is arranged outside the first door body 21, and the latch member 33 is arranged outside the second door body 22). Thus, it is convenient to operate the door-latching assembly 3 to realize the closing locking and unlocking opening of the side-by-side door 2.

In some embodiments of the present disclosure, as illustrated in FIGS. 1 and 2, when the door-latching assembly 3 is arranged inside the side-by-side door body 2, the second door body 22 defines a manipulation hole 222 to manipulate the movement of the latch member 33 between the locked position and the unlocked position. That is, technicians can manipulate the latch member 33 located inside the second door body 22 through the manipulation hole 222, to allow the latch member 33 to move between the locked position and the unlocked position. Thus, it is convenient to operate the door-latching assembly 3 to realize the closing locking and unlocking opening of the side-by-side door 2.

In some embodiments of the present disclosure, as illustrated in FIG. 1 and FIG. 2, the latch member 33 is provided with a handgrip portion 330 (such as a handgrip groove 330A, a handgrip hole, a handgrip ring, and so on). During the movement of the latch member 33 between the locked position and the unlocked position, the handgrip portion 330 is always opposite to the manipulation hole 222, such that when the door-latching assembly 3 is locked or unlocked, the technician can pull the handgrip portion 330 by passing his hand through the manipulation hole 222, to move the latch member 33 between the locked position and the unlocked position. Therefore, it is convenient to operate and process.

Certainly, the present disclosure is not limited thereto. The second door body 22 may have no manipulation hole 222, and the latch member 33 may have no handgrip portion 330. The movement of the latch member 33 can be controlled by other means. For example, the latch member 33 may be iron or a magnet, in which case the latch member 33 can be attracted and pulled by a magnet outside the second door body 22, thereby moving between the locked position and the unlocked position. Certainly, the second door body 22 may also have the manipulation hole 222, and the magnet is magnetically attracted with the latch member 33 through the manipulation hole 222.

In some embodiments of the present disclosure, as illustrated in FIG. 8, FIG. 10, FIG. 12 and FIG. 14, the door-latching assembly 3 also includes a limiting member 34 provided on the second door body 22, and there are two limiting portions 341 (such as protrusions, screws 341A, flanges 341B, and so on) on the limiting member 34. The handgrip portion 330 is configured as a handgrip groove 330A formed by a surface of the latch member 33 recessed inwardly, and the handgrip groove 330A moves between the two limiting portions 341, such that the locked position and the unlocked position can be reached respectively when two opposite side walls of the handgrip groove 330A abut against the two limiting portions 341. That is, when one side wall 331 of the handgrip groove 330A abuts against one of the limiting portions (such as a screw 341A), the latch member 33 reaches the locked position; when the other side wall 332 of the handgrip groove 330A abuts against the other limiting portion (such as a flange 341B), the latch member 33 reaches the unlocked position. Therefore, the structural design of the latch member 33 is ingenious and easy to process, and it can be ensured that the latch member 33 moves reliably between the locked position and the unlocked position and avoid the problem of moving beyond position.

Figure 6:
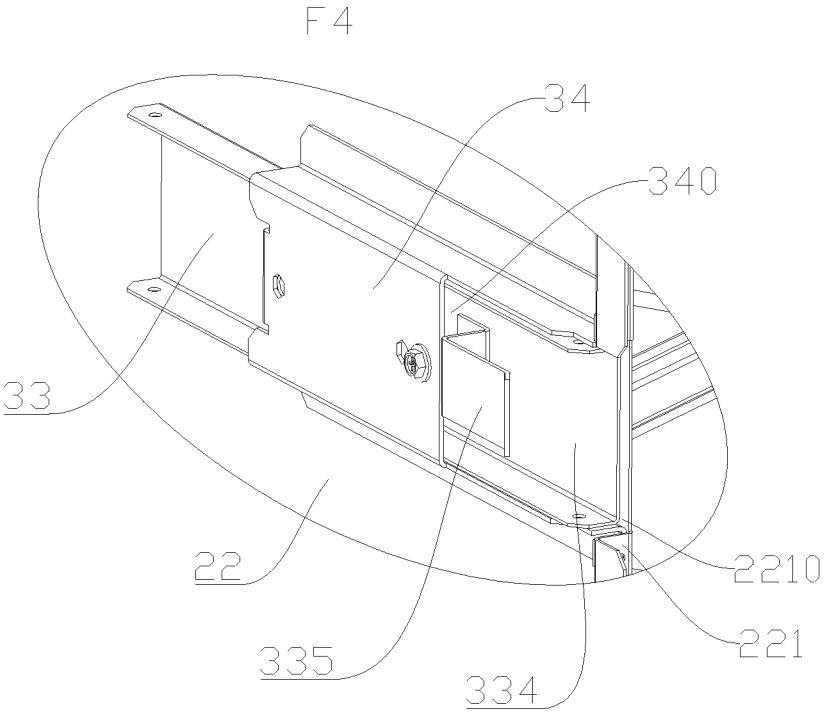
FIG. 6 is an enlarged view of part F4 circled in FIG. 3.

In addition, in some specific examples of the present disclosure, as illustrated in FIG. 6, a sliding channel 340 can be defined between the limiting member 34 and the second door body 22, and the latch member 33 can be slidably inserted in the sliding channel 340 to realize the movement between the locked position and the unlocked position. Thus, the movement trajectory of the latch member 33 can be limited to prevent the latch member 33 from moving off the track, so as to improve the reliability, effectiveness and rapidity of the locking and unlocking of the latch member 33. Certainly, the present disclosure is not limited thereto. In other embodiments of the present disclosure, the limiting member 34 may also be omitted. Structure for limiting the movement trajectory of the latch member 33 may be processed on the second door body 22.

Figure 12:
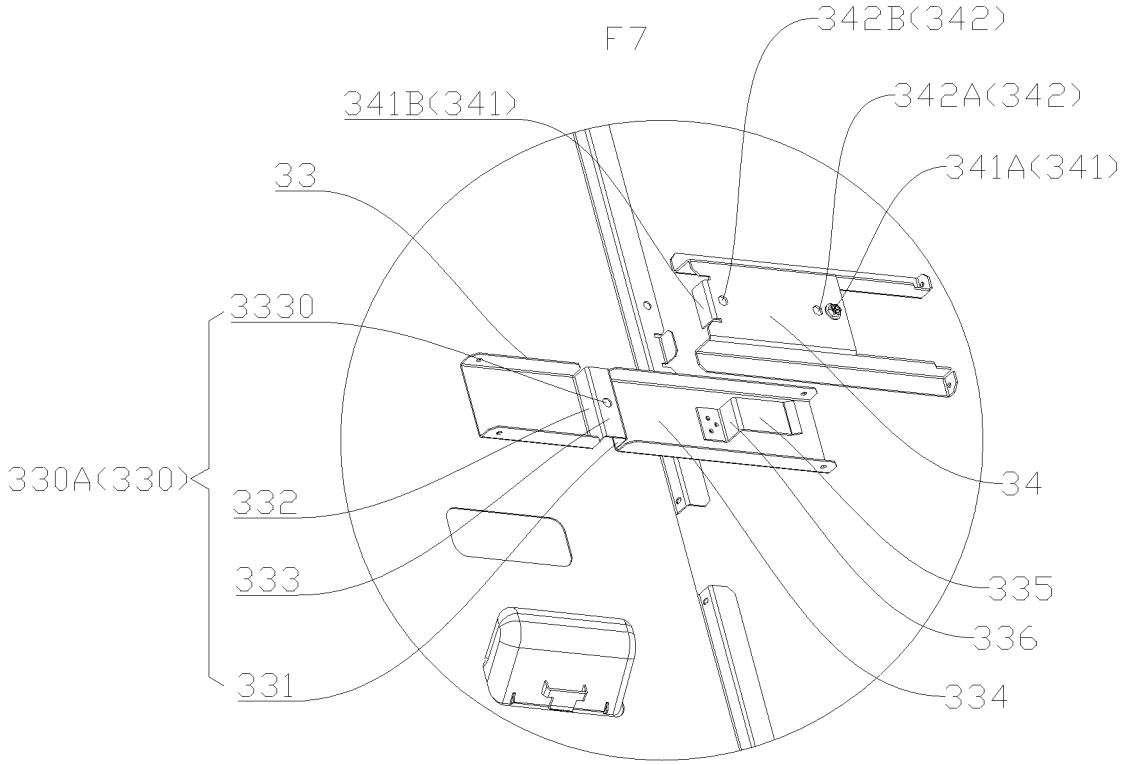
FIG. 12 is an enlarged view of part F7 circled in FIG. 11.
Figure 13:
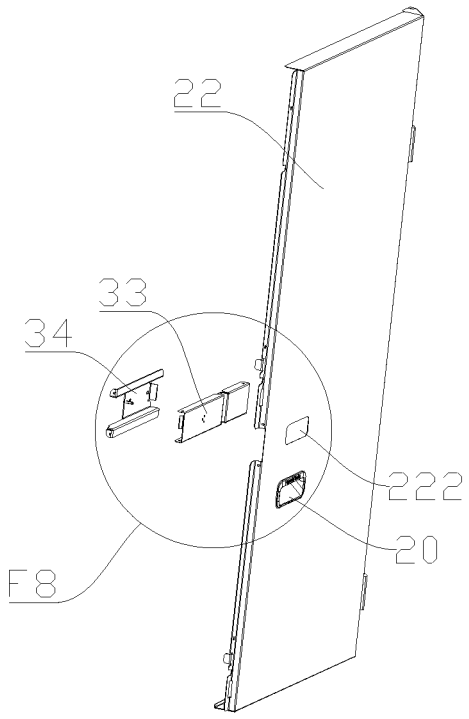
FIG. 13 is another exploded view of a second door body, a latch member and a limiting member illustrated in FIG. 9.
Figure 14:
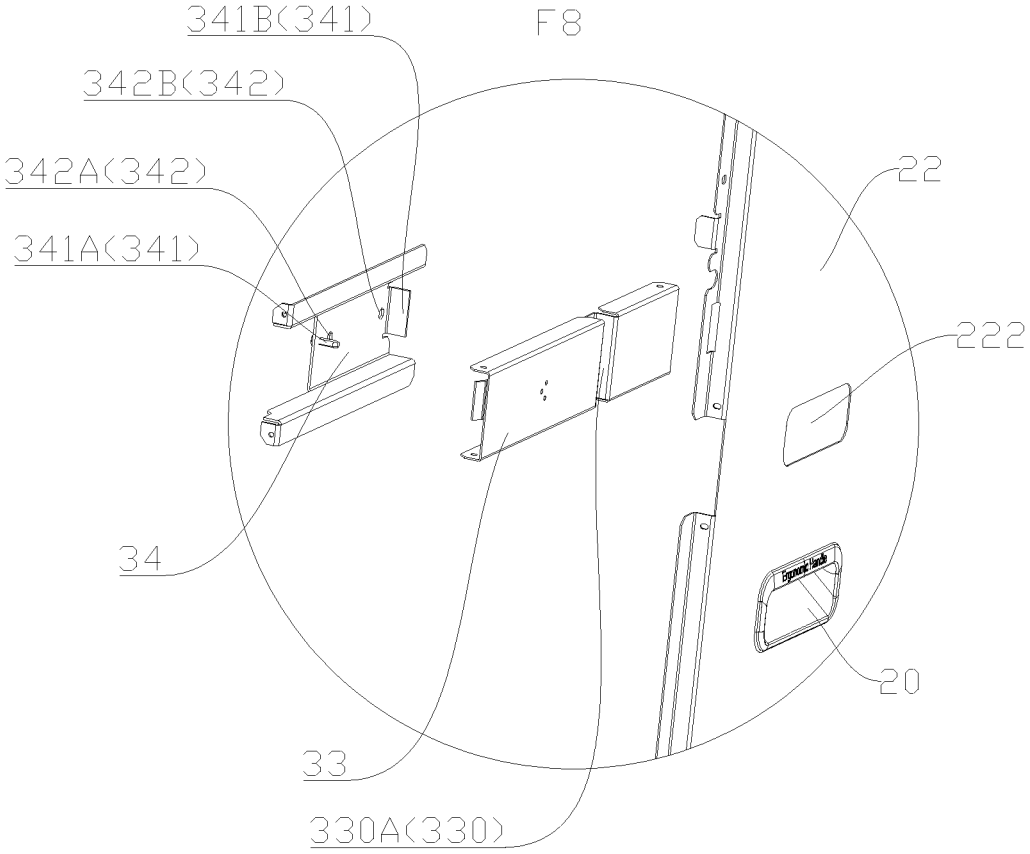
FIG. 14 is an enlarged view of part F8 circled in FIG. 13.

In some embodiments of the present disclosure, as illustrated in FIG. 12, a bottom wall 333 of the handgrip groove 330A (i.e., a bottom wall in a recessing direction) has a locking hole 3330, and the limiting member 34 has at least one positioning hole 342. When the locking hole 3330 is opposite to the positioning hole 342, a threaded connector can be locked with the positioning hole 342 by passing through the locking hole 3330 via the manipulation hole 222 (the positioning hole 342 itself may have an internal thread or a rivet nut to be fitted and locked with the thread connector). Thus, during transportation of the outdoor unit, the latch member 33 can be prevented from swinging freely between the locked position and the unlocked position, which may otherwise result in noise and wear due to collision. Certainly, the present disclosure is not limited thereto. In other embodiments of the present disclosure, both the positioning hole 342 and the locking hole 3330 may be omitted.

Preferably, as illustrated in FIG. 12, two positioning holes 342 are provided and arranged adjacent to the two limiting portions 341 respectively, such that the locking hole 3330 is corresponding to the two positioning holes 342 separately when the latch member 33 moves to the locked position or the unlocked position. That is, one positioning hole 342A is arranged adjacent to one limiting portion 341A and the other positioning hole 342B is arranged adjacent to the other limiting portion 341B. When the latch member 33 moves to the locked position, one side wall 331 of the handgrip groove 330A abuts against one limiting portion 341A, in which case the locking hole 3330 on the bottom wall 333 of the handgrip groove 330A can be corresponding to one positioning hole 342A. After the locking hole 3330 is locked with this positioning hole 342 by the threaded fastener, the latch member 33 can stay in the locked position. When the latch member 33 moves to the unlocked position, the other side wall 332 of the handgrip groove 330A abuts against the other limiting portion 341*b*, in which case the locking hole 3330 on the bottom wall 333 of the handgrip groove 330A can be corresponding to the other positioning hole 342B. After the locking hole 3330 is locked with this positioning hole 342 by the threaded fastener, the latch member 33 can stay in the unlocked position. Thus, it is convenient to align and lock the locking hole 3330 with the positioning hole 342.

In some embodiments of the present disclosure, as illustrated in FIG. 8, FIG. 10 and FIG. 12, the latch member 33 moves reciprocally and translationally between the locked position and the unlocked position. The latch member 33 includes a first locking plate 334 and a second locking plate 335 spaced in a direction perpendicular to a moving direction of the latch member 33 (the second locking plate 335 may be connected to the first locking plate 334 by means of a connecting plate 336). When the latch member 33 moves to the locked position, the first locking plate 334 cooperates with the door-locking member 32 in a locked manner, and the second locking plate 335 cooperates with the cabinet-locking member 31 in a locked manner. Thus, it facilitates positional layout of the cabinet-locking member 31 and the door-locking member 32, and the structure of the latch member 33 is simple and easy to process.

In some embodiments of the present disclosure, as illustrated in FIG. 1 and FIG. 3, a front side of the cabinet body 1 is open and the cabinet body 1 includes a center beam 10 vertically provided in the center of the front side. One of the first door body 21 and the second door body 22 is hinged to a left side edge of the cabinet body 1 and is located between the left side edge and the center beam 10 when closed; the other one thereof is hinged to a right side edge of the cabinet body 1 and is located between the right side edge and the center beam 10 when closed. The cabinet-locking member 31 is arranged on the center beam 10. Thus, the overall structure of the housing 100 is simple and easy for processing and mounting. The side-by-side door 2 is convenient to open and close, and the door-latching assembly 3 is convenient to be locked and unlocked. The door-latch member 32 is preferably arranged on a part of the first door body 21 close to the center beam 10, so as to be close to the cabinet-locking member 31. The latch member 33 is arranged on a part of the second door body 22 close to the center beam 10, so as to be close to the cabinet-locking member 31. Thus, the structure can be further simplified.

Preferably, as illustrated in FIG. 1, the cabinet-locking member 31 is arranged at a middle portion of the center beam 10 (in an up-down direction); the door-locking member 32 is arranged at a middle portion of a side of the first door body 21 close to the center beam 10 (in the up-down direction); the latch member 33 is arranged at a middle portion of a side of the second door body 22 close to the center beam 10 (in the up-down direction). Thus, technicians can access the door-latching assembly 3 more easily, thereby improving the operational convenience and efficiency.

Certainly, the present disclosure is not limited to this. In other embodiments of the present disclosure, the cabinet-locking member 31 may also be arranged at other positions of the cabinet body 1. For example, the center beam 10 may be omitted, and the cabinet-locking member 31 may be directly arranged on a top edge or a bottom edge of the cabinet body, which will not be described herein.

In some embodiments of the present disclosure, as illustrated in FIG. 1, at least one of the first door body 21 and the second door body 22 has a door handle portion 20 (such as a hand ring, a hand groove, a hand hole, and so on). Thus, when the first door body 21 and the second door body 22 are opened, the first door body 21 and/or the second door body 22 can be easily opened by simply pulling the door handle portion 20 without need to use a tool to pry. Certainly, the present disclosure is not limited thereto, and the first door body 21 and the second door body 22 may also have no door handle portion 20.

Referring to FIGS. 1-14, the housing 100 for the outdoor unit of the air conditioner according to a specific embodiment of the present disclosure will be described briefly below. The housing 100 includes a cabinet body 1, a first door body 21, a second door body 22 and a door-latching assembly 3. A front side of the cabinet body 1 is open, and a center beam 10 is vertically provided in the center of the front side of the cabinet body 1. The first door body 21 is arranged at a left part of the front side of the cabinet body 1 and is hingedly connected with a left edge of the front side of the cabinet body 1 to pivot leftwards to be opened and pivot rightwards to be closed. The second door body 22 is arranged at a right part of the front side of the cabinet body 1 and is hingedly connected with a right edge of the front side of the cabinet body 1 to pivot rightwards to be opened and pivot leftwards to be closed.

A right side edge of the first door body 21 has a first side wall 211 extending backward, and a left side edge of the second door body 22 has a second side wall 221 extending backward. A middle portion of the first side wall 211 defines a through hole 2110, and a middle portion of the second side wall 221 defines a through hole 2210. The door-latching assembly 3 includes a cabinet-locking member 31, a door-locking member 32, a latch member 33 and a limiting member 34. The cabinet-locking member 31 has a shape of a door frame and is welded to a center of a front side of the middle beam 10, and a cabinet-limiting space 310 extending along a left-right direction is defined between the cabinet-locking member 31 and the center beam 10. The door-locking member 32 is of a door frame shape and is welded at a right center of a rear side of the first door body 21, and a door-limiting space 320 extending along the left-right direction is defined between the door-locking member 32 and the first door body 21. The door-limiting space 320 is communicated with the through hole 2110 in the first side wall 211. The limiting member 34 is of a door frame shape and is welded at a left center of a rear side of the second door body 22, and a sliding channel 340 extending along the left-right direction is defined between the limiting member 34 and the second door body 22. The sliding channel 340 is communicated with the through hole 2210 in the second side wall 221.

A length direction of the latch member 33 is the left-right direction, and a width direction thereof is the up-down direction. The latch member 33 is slidably inserted in the sliding channel 340. The second door body 22 has a manipulation hole 222, and the latch member 33 has a handgrip groove 330A arranged corresponding to the manipulation hole 222. The limiting member 34 is provided with a flange 341B and a screw 341A spaced apart from each other in the left-right direction, to construct two limiting portions 341 spaced apart from each other in the left-right direction. The handgrip groove 330A moves between the two limiting portions 341, such that the two limiting portions 341 can limit a distance by which the latch member 33 can slide in the left-right direction. Specifically, a part of the latch member 33 on the side of the handgrip groove 330A is a first locking plate 334, and a second locking plate 335 is parallelly provided at a rear side of the first locking plate 334 and is welded to the first locking plate 334 by means of a connecting plate 336.

When the side-by-side door 2 needs to be closed, the first door body 21 and the second door body 22 are first pushed to the closed position, and then a hand extends into the manipulation hole 222 and the handgrip groove 330A from the outside to pull the latch member 33 to move leftwards until a left side wall 331 of the handgrip groove 330A abuts against the limiting portion 341 configured by the screw 341A, in which case that the latch member 33 reaches the locked position. At this time, the first locking plate 334 passes through the through hole 2210 and the through hole 2110 successively and enters the door-limiting space 320 where the first locking plate 334 is fitted and locked with the door-locking member 32. At the same time, the second locking plate 335 enters the cabinet-limiting space 310 where the second locking plate 335 is fitted and locked with the cabinet-locking member 31. The side-by-side door 2 is locked in a closed state, that is, the first door body 21 and the second door body 22 are both locked in the closed position and are stationary with respect to the cabinet body 1. Thus, the sliding of the door-latching assembly 3 due to the operation vibration of the outdoor unit can be prevented, which may otherwise result in a problem that the side-by-side door 2 is opened.

When the side-by-side door 2 needs to be opened, a hand extends into the manipulation hole 222 and the handgrip groove 330A from the outside to pull the latch member 33 to move rightwards until a right side wall 332 of the handgrip groove 330A abuts against the limiting portion 341 configured by the flange 341B, in which case the latch member 33 reaches the unlocked position. At this time, the first locking plate 334 are pulled out from the door-limiting space 320, the through hole 2210, and the through hole 2110 successively. At the same time, the second locking plate 335 is pulled out rightwards from the cabinet-limiting space 310. Thus, the side-by-side door 2 is released, and the first door body 21 and the second door body can be pulled, to allow the side-by-side door 2 to exhibit an open state. As a result, working parts inside the cabinet body 1 can be maintained and cleaned.

An outdoor unit for an air conditioner according to embodiments of a second aspect of the present disclosure includes the above housing 100 according to embodiments of the first aspect of the present disclosure and a heat exchanger arranged in the housing 100 (not illustrated in the drawings). In addition, other components of the outdoor unit according to embodiments of the present disclosure, such as an air blower (not illustrated in the drawings), are known to those skilled in related art, which will not be described in detail herein.

For the outdoor unit according to embodiments of the present disclosure, the maintenance convenience of the outdoor unit is improved by providing the housing 100 according to the embodiments of the above first aspect.

In the description of the present disclosure, it should be understood that, the orientation or position relationship indicated by the terms "up", "down", "front", "rear", "left", "right", "top", "bottom", "inside", "outside" thereof are based on the orientation or position relationship illustrated in the drawings. These terms are for convenience and simplification of description and do not indicate or imply that the device or element referred to must have a specific orientation, be constructed and operated in a specific orientation, so these terms shall not be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present disclosure, "a plurality of" means two or more than two, unless specified otherwise.

In the present disclosure, it should be noted, unless specified or limited otherwise, the terms "mounted", "connected", "coupled", "fixed," or the like are used broadly. The terms may indicate, for example, fixed connections, detachable connections, or integral connections, may also indicate direct connections or indirect connections via intermediate mediums, and may also indicate inner communications of two elements or the interaction between two elements. The specific meanings of the terms in embodiments of the present disclosure may be understood by those skilled in the art according to particular circumstances.

In the descriptions of the present disclosure, it should be noted that, unless otherwise expressly specified and limited, the first feature "on" or "under" the second feature may be that the first and second features are in direct contact, or that the first and second features are in indirect contact through an intermediate medium. Moreover, the first feature "up", "above" and "on" the second feature may be that the first feature is directly above or obliquely above the second feature, or merely be that the first feature has a level higher than the second feature. The first feature "down", "below" and "under" the second feature may be that the first feature is directly below or obliquely below the second feature, or merely be that the first feature has a level less than the second feature.

Reference throughout this specification to terms "an embodiment," "some embodiments," "an example", "a specific example," or "some examples," means that a particular feature, structure, material, or characteristic described in connection with the embodiment or example is included in at least one embodiment or example of the present disclosure. In this specification, exemplary descriptions of aforesaid terms are not necessarily referring to the same embodiment or example.

Moreover, the particular features, structures, materials, or characteristics described may be combined in any suitable manner in one or more embodiments or examples. Furthermore, in the case of non-contradiction, those skilled in the art may combine and group the different embodiments or examples described in this specification and the features of the different embodiments or examples.

Although embodiments of the present disclosure have been illustrated and described above, it should be understood by those skilled in the art that changes, modifications, alternatives, and variations may be made in the embodiments without departing from principles and purposes of the present disclosure. The scope of the present disclosure is limited by the claims and their equivalents.

The invention claimed is:

1. A housing for an outdoor unit of an air conditioner, comprising:

a cabinet body;

a side-by-side door configured to open and close the cabinet body and comprising a first door body and a second door body that are opened side by side;

a door-latching assembly comprising a cabinet-locking member provided on the cabinet body, a door-locking member provided on the first door body and a latch member provided on the second door body, the latch member being movable with respect to the second door body between a locked position where the latch member cooperates with both the cabinet-locking member and the door-locking member in a locked manner and an unlocked position where the latch member is separated from both the cabinet-locking member and the door-locking member;

wherein the second door body has a manipulation hole configured to manipulate movement of the latch member between the locked position and the unlocked position; and wherein the latch member is provided with a handgrip portion, and during the movement of the latch member between the locked position and the unlocked position, the handgrip portion keeps corresponding to the manipulation hole.

2. The housing according to claim 1, wherein the door-latching assembly is arranged inside the side-by-side door.

3. The housing according to claim 1, wherein the door-latching assembly further comprises a limiting member provided on the second door body, the limiting member has two limiting portions, the handgrip portion is configured as a handgrip groove formed by a surface of the latch member recessed inwardly, and the handgrip groove moves between the two limiting portions, such that the locked position and the unlocked position can be reached respectively when two opposite side walls of the handgrip groove abut against the two limiting portions separately.

4. The housing according to claim 3, wherein a bottom wall of the handgrip groove has a locking hole, the limiting member has at least one positioning hole, and when the locking hole is opposite to the positioning hole, a threaded connector can pass through the manipulation hole and the locking hole to be locked with the positioning hole.

5. The housing according to claim 4, wherein two positioning holes are provided and arranged adjacent to the two limiting portions respectively, such that the locking hole is corresponding to the two positioning holes separately when the latch member moves to the locked position and the unlocked position.

6. The housing according to claim 1, wherein the latch member moves reciprocally and translationally between the locked position and the unlocked position, the latch member comprises a first locking plate and a second locking plate spaced in a direction perpendicular to a moving direction of the latch member, and when the latch member moves to the locked position, the first locking plate cooperates with the door-locking member in a locked manner, and the second locking plate cooperates with the cabinet-locking member in a locked manner.

7. The housing according to claim 1, wherein the cabinet body is open on a front side of the outdoor unit, and comprises a center beam vertically provided in the center of the front side; one of the first door body and the second door body is hinged to a left side edge of the cabinet body and is located between the left side edge and the center beam when closed, and the other one is the second door body and is hinged to a right side edge of the cabinet body and is located between the right side edge and the center beam when closed; the cabinet-locking member is arranged on the center beam.

8. The housing according to claim 7, wherein the cabinet-locking member is arranged at a middle portion of the center beam, the door-locking member is arranged at a middle portion of a side of the first door body close to the center beam, and the latch member is arranged at a middle portion of a side of the second door body close to the center beam.

9. The housing according to claim 1, wherein at least one of the first door body and the second door body has a door handle portion.

10. An outdoor unit for an air conditioner, comprising: the housing for the outdoor unit of an air conditioner according to claim 1 and a heat exchanger provided in the housing.

11. The housing according to claim 2, wherein at least one of the first door body and the second door body has a door handle portion.

12. An outdoor unit for an air conditioner, comprising: the housing for the outdoor unit of an air conditioner according to claim 2 and a heat exchanger provided in the housing.

13. An outdoor unit for an air conditioner, comprising: the housing for the outdoor unit of an air conditioner according to claim 1 and a heat exchanger provided in the housing.

14. An outdoor unit for an air conditioner, comprising: the housing for the outdoor unit of an air conditioner according to claim 1 and a heat exchanger provided in the housing.

15. An outdoor unit for an air conditioner, comprising: the housing for the outdoor unit of an air conditioner according to claim 3 and a heat exchanger provided in the housing.

16. An outdoor unit for an air conditioner, comprising: the housing for the outdoor unit of an air conditioner according to claim 4 and a heat exchanger provided in the housing.

* * * * *